US009776775B2

(12) United States Patent
Fournier et al.

(10) Patent No.: US 9,776,775 B2
(45) Date of Patent: Oct. 3, 2017

(54) FASTENING DEVICE FOR SEALING A FLUID PRODUCT RESERVOIR

(71) Applicant: APTAR STELMI SAS, Villepinte (FR)

(72) Inventors: Ghislain Fournier, La Rochelle (FR); Mickael Swal, Chauconin Neufmontiers (FR)

(73) Assignee: APTAR STELMI SAS, Villenpinte (FR)

( * ) Notice: Subject to any disclaimer, the term of this patent is extended or adjusted under 35 U.S.C. 154(b) by 46 days.

(21) Appl. No.: 14/763,565

(22) PCT Filed: Feb. 11, 2014

(86) PCT No.: PCT/FR2014/050256
§ 371 (c)(1),
(2) Date: Jul. 27, 2015

(87) PCT Pub. No.: WO2014/125202
PCT Pub. Date: Aug. 21, 2014

(65) Prior Publication Data

US 2016/0009460 A1 Jan. 14, 2016

(30) Foreign Application Priority Data

Feb. 14, 2013 (FR) ..... 13 51279

(51) Int. Cl.
*A61J 1/00* (2006.01)
*B65D 45/30* (2006.01)
(Continued)

(52) U.S. Cl.
CPC ..... *B65D 45/30* (2013.01); *A61J 1/00* (2013.01); *B05B 11/3049* (2013.01);
(Continued)

(58) Field of Classification Search
CPC .... B65D 41/16; B65D 45/322; B65D 51/002; B05B 11/3049; A61J 1/00
(Continued)

(56) References Cited

U.S. PATENT DOCUMENTS 5,799,810 A 9/1998 De Pous et al.
2003/0150876 A1 8/2003 Walters et al.
(Continued)

FOREIGN PATENT DOCUMENTS

EP 0 704 251 A2 4/1996
EP 2 198 973 A1 6/2010
(Continued)

OTHER PUBLICATIONS

International Preliminary Report on Patentability dated Aug. 27, 2015, issued by the International Bureau in corresponding International Application No. PCT/FR2014/050256.
(Continued)

*Primary Examiner* — James N Smalley
(74) *Attorney, Agent, or Firm* — Sughrue Mion, PLLC

(57) ABSTRACT

A fastener device for closing a fluid reservoir (1) having a neck (10) with outer peripheral reinforcement (11) that co-operates with the neck to define a bottom shoulder (12). The fastener device includes a fastener ring (2) for holding a closure member (4) on the neck (10), and which includes a peripheral skirt (21) extending around the neck below the bottom shoulder (12). The skirt (21) is provided with fastener elements (26*a*, 26*b*) forming contact zones (27*a*, 27*b*) for coming into engagement with the neck (10) below the bottom shoulder (12). A blocking hoop (3) is provided that is engaged around the peripheral skirt (21) in a final mounted position. The peripheral skirt (21) forms vertical blades (22) separated by axial slots (23), the blocking hoop (3) forming
(Continued)

vertical branches (33) that are arranged in the axial slots (23) between two vertical blades (22), in the mounted position.

16 Claims, 3 Drawing Sheets

(51) Int. Cl.
*B05B 11/00* (2006.01)
*B65D 45/32* (2006.01)
*B65D 51/00* (2006.01)
*B65D 39/00* (2006.01)

(52) U.S. Cl.
CPC ..... *B65D 39/0005* (2013.01); *B65D 45/322* (2013.01); *B65D 51/002* (2013.01); *B65D 2539/006* (2013.01)

(58) Field of Classification Search
USPC ..... 220/315, 319, 320; 215/247, 249, 277; 222/321.7
See application file for complete search history.

(56) References Cited

U.S. PATENT DOCUMENTS

2009/0224005 A1 9/2009 Jourdin et al.
2009/0283549 A1 11/2009 Beranger
2011/0031281 A1 2/2011 Leleu
2012/0160850 A1* 6/2012 Gelibert ..... B65D 55/063 220/320

FOREIGN PATENT DOCUMENTS

FR 2 884 806 A1 10/2006
FR 2 891 530 A1 4/2007
FR WO 2011032798 A1 * 3/2011 ..... B65D 51/002

OTHER PUBLICATIONS

International Search Report for PCT/FR2014/050256 dated Jun. 3, 2014.

* cited by examiner

FASTENING DEVICE FOR SEALING A FLUID PRODUCT RESERVOIR

CROSS REFERENCE TO RELATED APPLICATIONS

This application is a National Stage of International Application No. PCT/FR2014/050256 filed Feb. 11, 2014, claiming priority based on French Patent Application No. 1351279 filed Feb. 14, 2013, the contents of all of which are incorporated herein by reference in their entirety.

The present invention relates to a fastener device for closing, in leaktight manner, a fluid reservoir that may be in the form of a bottle, a carpule, a pre-filled syringe, a cartridge, etc. The reservoir forms a neck that is provided with outer peripheral reinforcement that co-operates with the remainder of the neck to define a bottom shoulder below which the fastener device catches. The advantageous field of application of the present invention is the field of reservoirs that are closed by means of a closure member that is perforable by means of a needle. However, the present invention may also apply to other fields such as the fields of pharmacy, perfumery, and cosmetics, in which the closure member is associated with a pump or a valve.

In general, the fastener device comprises a fastener ring associated with a blocking hoop that is engaged around the fastener ring. In the prior art, numerous documents are known that describe this type of fastener device. In the field of pumps, document EP 0 704 251 describes a fastener ring including a peripheral skirt that is provided internally with fastener heads for coming into engagement below the shoulder of the neck. In order to block the fastener heads below the shoulder, a blocking hoop is provided that is engaged axially around the skirt. The radial thickness of that fastener device around the neck corresponds to the combined thicknesses of the skirt and the hoop. In some circumstances, the combined radial thickness is substantial, and incompatible with the configuration of the reservoir that is to be used.

An object of the present invention is to remedy the above-mentioned prior-art drawbacks by defining a ring and hoop fastener device that is radially compact around the neck.

Translation of the title as established ex officio.

To do this the present invention proposes a fastener device for closing a fluid reservoir that is formed with a neck that is provided with outer peripheral reinforcement that co-operates with the remainder of the neck to define a bottom shoulder, said fastener device comprising: a fastener ring for holding a closure member on the neck, the fastener ring including a peripheral skirt that extends around the neck to below the bottom shoulder, said skirt being provided with fastener elements that each form a contact zone that is suitable for potentially coming into engagement with the neck below the bottom shoulder, so as to fasten the ring on the neck; and a blocking hoop that is engaged around the peripheral skirt in a final mounted position, so as to block at least some of the fastener elements below the bottom shoulder; the fastener device being characterized in that the peripheral skirt forms vertical blades that are separated by axial slots, the blocking hoop forming vertical branches that are arranged in the axial slots between two vertical blades, in the final mounted position. Thus, the vertical branches of the blocking hoop are nested in the peripheral skirt in its axial slots, such that the vertical branches do not create any extra thickness either inwards or outwards. Furthermore, by filling the axial slots, the vertical branches reinforce the structure and the strength of the peripheral skirt.

In a practical embodiment, the blocking hoop comprises a top disk that is connected to a bottom blocking collar via at least two axial vertical branches. Advantageously, the fastener elements extend downwards below the vertical blades and are set back towards the inside, such that the blocking collar is received below the blades, in alignment therewith, in bearing contact with the fastener elements, in the final mounted position. As with the vertical branches, the blocking collar is well incorporated in the skirt, extending it downwards around the fastener elements. Not only does the blocking collar not create any extra radial thickness, but it also reinforces the structure and the firmness of the peripheral skirt considerably. Specifically, the blocking collar clamps the fastener elements, thereby urging the blades towards one another at the slots, thus jamming the vertical branches between them. Preferably, the blocking collar is elastically deformable. Thus, the blocking collar may be expanded temporarily while passing over the blades in order to reach its final mounted position in engagement with the fastener elements, below the blades.

In another advantageous aspect of the invention, the axial slots extend over the entire height of the skirt, such that the branches extend in the axial slots without creating extra thickness at the skirt. Thus, the branches do not even need to be deformed in order to become positioned in the slots between two adjacent blades.

According to another characteristic of the invention, the blocking hoop forms a blocking collar that is held temporarily on the skirt of the fastener ring in a pre-mounted position, before being moved axially into its final mounted position. Thus, the ring and the hoop co-operate with each other to form a solid unit that can be handled easily, in particular while mounting on a reservoir neck.

According to another characteristic of the invention, some vertical blades are interconnected at their bottom ends via spacers that support the fastener elements, a pair of vertical blades thus forming between them a window above their respective spacer. The fastener elements may project inwards and downwards from the spacers.

In another advantageous aspect of the invention, the contact zones are situated at different axial heights, such that some contact zones come into operating engagement below the bottom shoulder, while other contact zones remain inoperative. Advantageously, the fastener elements are radially movable, so as to pass over the outer reinforcement of the neck and come into engagement below the bottom shoulder. Thus, it is possible to fasten the fastener ring on a reservoir neck, even if dimensional, compression, and manufacturing tolerances of the closure member and of the neck are substantial.

In a practical embodiment, the fastener elements comprise tabs that extend freely downwards, the tabs forming inwardly- and upwardly-directed rims that define contact zones of different axial heights.

The invention also defines a fluid reservoir including a neck that is provided with a fastener device as described above, for holding a closure member on the neck. The closure member may be a simple perforable disk made of elastomer, or it may be a neck gasket that is associated with a dispenser member, such as a pump or a valve.

The spirit of the invention resides in incorporating or nesting the blocking hoop structurally into the fastener ring, in such a manner as to eliminate any extra radial thickness at the neck, while reinforcing the structure, the strength, and the firmness of the ring.

The invention is described more fully below with reference to the accompanying drawings which show two embodiments of the invention by way of non-limiting example.

IN THE FIGURES

Figure 1:
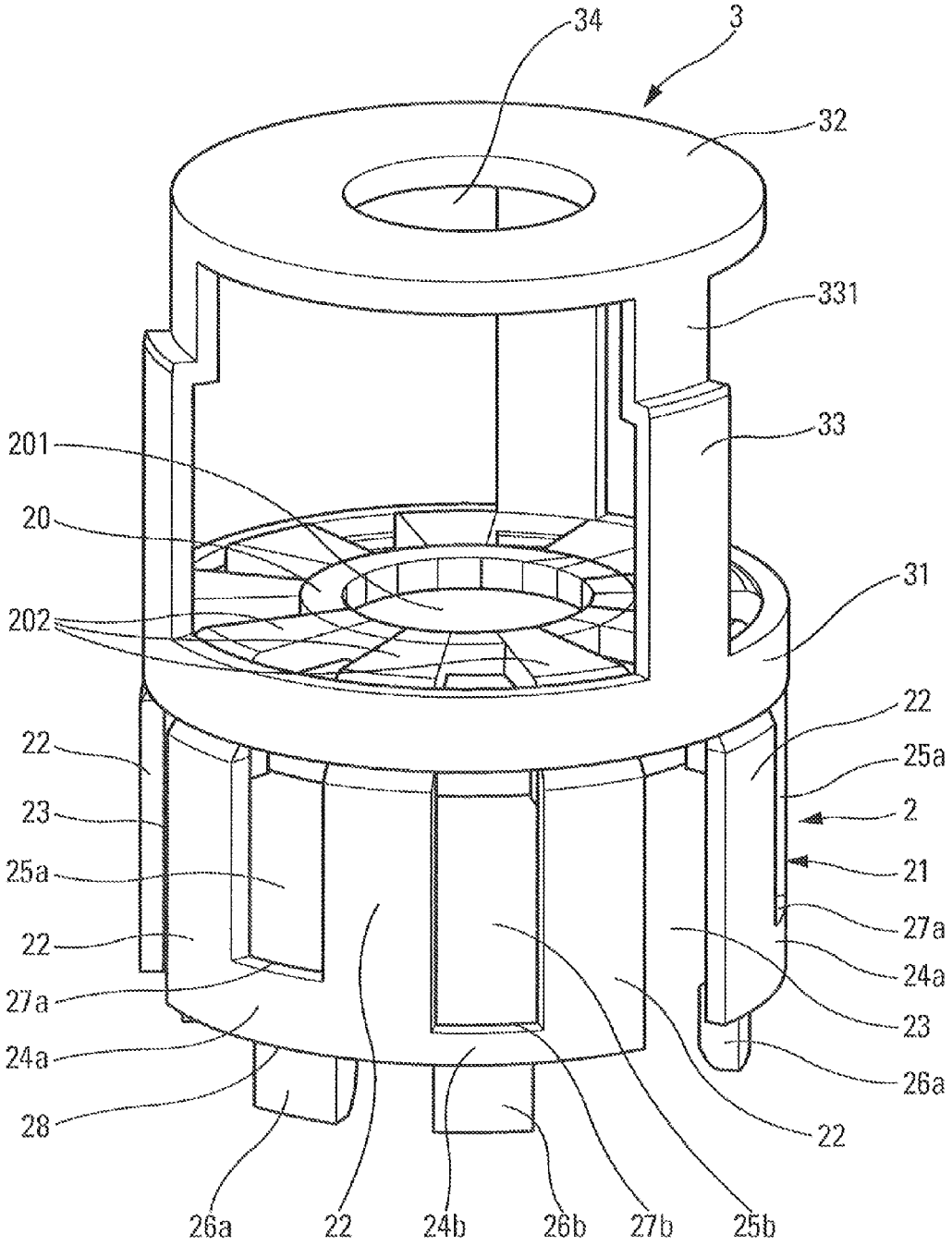
FIG. 1 is a much larger-scale perspective view of a fastener device in a first embodiment of the invention.
Figure 2:
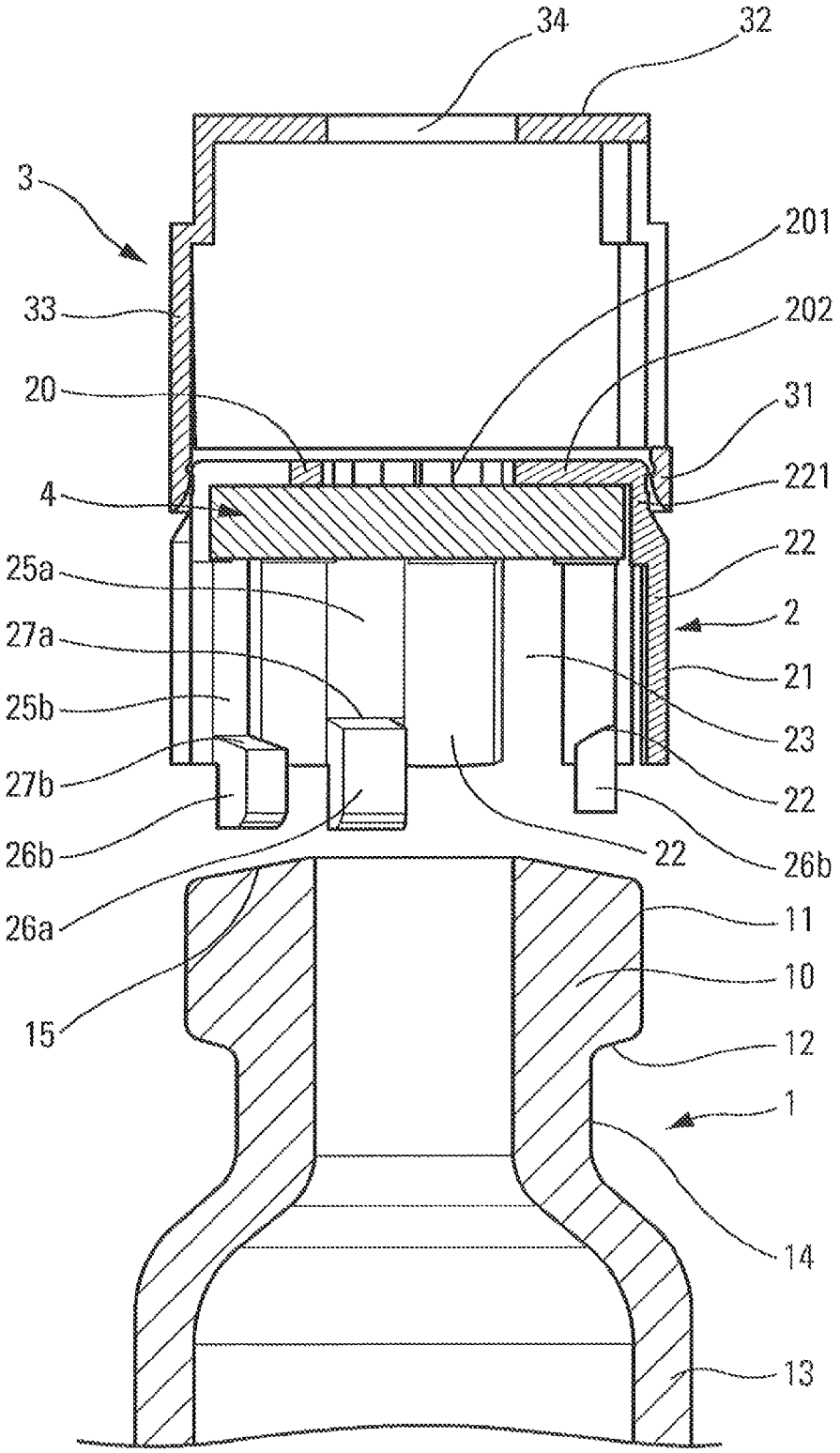
FIG. 2 is a section view through the FIG. 1 fastener device, ready to be mounted on a reservoir neck.

Reference is made firstly to FIGS. 1 and 2 in order to describe the structure of a device in the first embodiment of the invention. The fastener device comprises a fastener ring 2 and a blocking hoop 3 for mounting on a reservoir 1 in order to hold a closure member 4. The blocking hoop 3 may be an optional element in some applications.

The reservoir 1, that may be made of plastics material or of glass, is formed with a body 13 that is used to contain fluid, and a neck 10 at its top portion. It can be seen that the neck 10 extends from the body 13 with a cylindrical section 14, then forms an outwardly-directed shoulder 12, and is terminated by another cylindrical section of greater diameter, forming outer peripheral reinforcement 11. The shoulder 12 thus forms the transition between the reinforcement 11 and the remainder of the neck that forms the junction with the body 1. The neck also defines an annular edge 15. The reservoir may be in the form of a bottle, a carpule, a pre-filled syringe, a cartridge, etc. The bottom wall of the reservoir is permanent or removable.

In the embodiment shown, the closure member 4 is a disk or a pellet made of elastically-deformable material, e.g. rubber or any other elastomer material. Its thickness is about 0.5 millimeters (mm) to 30 mm, and its hardness on the shore A scale lies in the range 30 to 70. The closure member 4 is flattened against the annular edge 15 of the neck 10 with a force that makes it possible to reduce its thickness down to 40%. Although not shown, the closure member could equally well be in the form of a removable or permanent stopper, or in the form of a neck gasket that is associated with a dispenser member, such as a pump or a valve.

The fastener ring 2 is preferably made by injection-molding appropriate plastics material, e.g. polyethylene or polypropylene. The fastener ring 2 includes a top plate that is substantially plane and that includes a central collar 20 that internally defines an opening 201. The top plate also includes radial flanges 202 that extend outwards from the central collar 20 like spokes. The flanges 202 are spaced apart from one another and they are connected, at their outer periphery, to axial vertical blades 22 that are separated from one another either by axial slots 23 or by axial windows 25*a*, 25*b*. Fastener elements in the form of tabs 26*a*, 26*b* extend downwards from spacers 24*a*, 24*b* that interconnect certain blades 22. The blades 22, the spacers 24*a*, 24*b*, and the tabs 26*a*, 26*b* co-operate with one another to form a peripheral skirt 21 that is both slotted at the slots 23 and perforated at the windows 25*a*, 25*b*. It should be observed that the vertical axial slots 23 are open at their two axial ends, given that the blades 22 that are adjacent to a slot 23 are interconnected only via the central collar 20. Conversely, the blades 22 that are adjacent to a window 25*b* are interconnected via the spacer 24*b*. The same applies for the blades 22 that are adjacent to the windows 25*a*: they are interconnected via the spacer 24*a*. In the non-limiting embodiment in FIGS. 1 to 3*b*, three blades 22 are interconnected via a spacer 24*a* and a spacer 24*b*, the end blades being adjacent to two axial slots 23.

It should be observed that the windows 25*a* are smaller than the windows 25*b*, given that the spacer 24*a* is axially taller than the spacer 24*b*. With reference to FIG. 2, it can be seen that the threshold of the windows forms the top rim of the tabs 26*a* and 26*b*. The rims form contact zones 27*a*, 27*b* for potentially coming into engagement below the shoulder 12 of the neck 10. Given that the spacers 24*a* and 24*b* present different heights, the contact zones 27*a* and 27*b* are also situated at different levels or heights, as can be seen clearly in FIG. 2. It can clearly be seen that the tab 26*a* is taller than the tab 26*b*, such that the tab 26*a* may be described as a long tab and the tab 26*b* as a short tab. In other words, the distance between the contact zone 27*a* and the closure member 4 is shorter than the distance between the contact zone 27*b* and the closure member 4. It should also be observed that the tabs 26*a*, 26*b* extend inside the spacers 24*a*, 24*b*, such that they are set back from a bottom edge 28 formed conjointly by the blades 22 and the spacers 24*a*, 24*b*, as can be seen in FIG. 1.

Figure 3B:
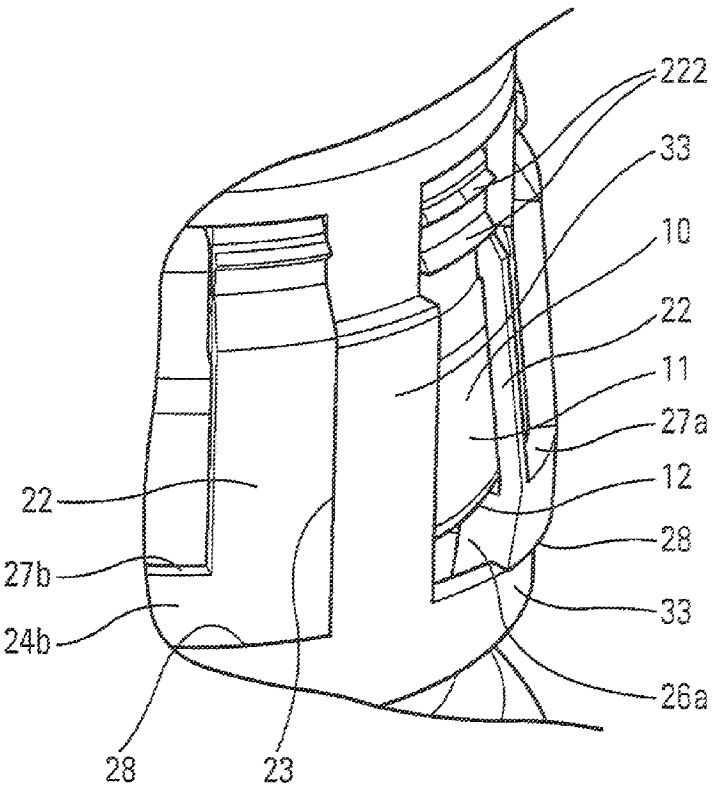
FIGS. 3*a* and 3*b* are fragmentary perspective views of the fastener device in FIGS. 1 and 2 during mounting on a reservoir neck.

The blades 22, in the proximity of their junctions with the flanges 202, form re-entrant risers 221 that may be provided with retainer profiles 222, shown in FIG. 3*b*.

The closure member 4 is arranged or pre-mounted inside the fastener ring 2, in contact with the top plate formed by the central collar 20 and its flanges 202. The peripheral edge of the closure member 4 may be engaged inside the re-entrant riser 221 formed by the blades 22. The closure member 4 is accessible from the outside through the opening 201.

The blocking hoop 3 includes a top disk 32 that defines a central passage 34 that is in alignment with the opening 201 of the ring 2. On its outer periphery, the disk 32 is provided with a plurality of vertical axial branches 33 that preferably present a profile that is comparable with, or identical to, the profile of the blades 22. By way of example, it should be observed that each branch 33 forms a re-entrant riser 331, like the riser 221 of the blades 22. The branches 33 are interconnected at their bottom ends via a blocking collar 31 that is preferably continuous over its entire periphery. The blocking hoop 3 may be made of a material that is relatively flexible or elastically deformable, such as polyethylene or polypropylene.

As can be seen in FIG. 1, the blocking hoop 3 may be mounted in temporary and non-permanent manner on the fastener ring 2 by engaging the blocking collar 31 around the re-entrant riser 221 of the blades 22 that are advantageously provided with retainer profiles 222. The blocking collar 31 may advantageously be made with corresponding profiles on its inside face so as to co-operate with the retainer profiles 222 of the re-entrant risers. In this pre-mounted temporary configuration, the blocking hoop 3 and the fastener ring 2 co-operate with each other to form a solid unit that is difficult to dismantle. This solid unit may be handled easily, in particular while mounting the fastener ring on a reservoir neck. It should be observed that the blocking hoop 3 may advantageously be oriented on the fastener ring 2 in such a manner as to position the vertical branches 33 above and in register with the vertical axial slots 23. To do this, it may be provided with orientation or indexer means that make it possible to position the hoop 3 angularly on the ring 2 in the position shown in FIG. 1.

Figure 3A:
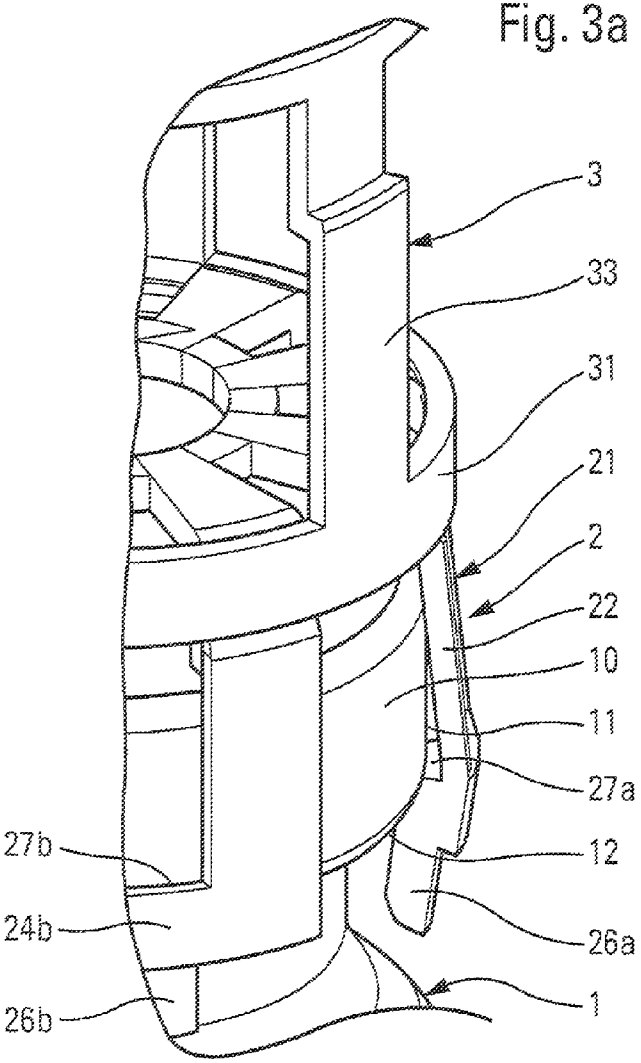

With reference to FIG. 3*a*, it can be seen that the peripheral skirt 21 is engaged around the neck 10 of the reservoir 1. The blocking hoop 3 is still in its pre-mounted temporary position. It should be observed that the contact zone 27*a* of the long tab 26*a* does not manage to be received below the shoulder 12 of the neck 10, whereas the contact zone 27*b* of the short tab 26*b* is engaged below the shoulder 12. In this application, the height of the peripheral reinforcement 11, and the thickness of the closure element 4 or its compressibility do not enable the long tabs to be engaged below the shoulder 12. With peripheral reinforcement 11 of smaller height, and/or a thinner or more flexible closure member, the long tabs 26*a* could engage below the shoulder 12, but, in this configuration, the contact zones 27*b* would then no longer be in contact with the shoulder 12. In FIG. 3*a*, the blade 22 that is adjacent to the long tab 26*a* is deformed outwards a little, and is constrained to remain in this state.

Axial thrust on the disk 32 of the blocking hoop 3 enables the blocking collar 31 to leave its pre-mounted temporary position and to slide with friction around the blades 22, so as to reach the final mounted position in which it comes to be received below the blades 22 and the spacers 24*a*, 24*b*, in contact with the outside face of the tabs 26*a*, 26*b*. The blocking collar 31 blocks the short tabs 26*b* below the shoulder 22 and stresses the long tabs 26*a* very strongly against the peripheral reinforcement 11. This is shown in FIG. 3*b*, in which it can be seen that the collar 33 is deformed outwards a little at the long tab 26*a* that cannot engage below the shoulder 12, or that can engage in part only. The blade 22 that is adjacent to the long tab 26*a* still slopes outwards a little. It should be observed that the blade 22 that is both adjacent to the long tab 26*a* and to the branch 33 has been cut away in part in FIG. 3*b* so as to show the incomplete engagement of the long tab 26*a* below the shoulder 12.

According to a characteristic of the invention, the vertical branches 33 of the blocking hoop 3 are arranged in the axial vertical slots 23 in such a manner as to fill them. As a result, the branches 33 finish off the peripheral skirt 21 in the slots 23. It should also be observed that the blocking collar 31 comes into alignment with the outer wall of the blades and is touching the bottom edge 28. Only the windows 25*a*, 25*b* remain open. By making the branches 23 with a wall thickness that is equal to, or less than, the wall thickness of the blades 22, they are completely nested in the windows without creating any extra radial thickness, either inwards or outwards. A fastener device is thus obtained having radial thickness around the neck that is limited to the thickness of the peripheral skirt 21. Furthermore, the branches 33 and the collar 31 consolidate the ring 2.

By means of the invention, the space occupied by the fastener device is greatly reduced, given that the blocking hoop 3 does not create extra thickness at the peripheral skirt of the fastener ring.

The invention claimed is:

1. A fastener device for closing a fluid reservoir that is formed with a neck that is provided with outer peripheral reinforcement that co-operates with the remainder of the neck to define a bottom shoulder, said fastener device comprising:

a fastener ring for holding a closure member on the neck, the fastener ring including a peripheral skirt that extends around the neck to below the bottom shoulder, said skirt being provided with fastener elements that each form a contact zone configured to engage the neck below the bottom shoulder, depending on an axial position of the respective contact zone relative to the bottom shoulder, so as to fasten the ring on the neck; and a blocking hoop that is engaged around the peripheral skirt in a final mounted position, so as to block at least some of the fastener elements below the bottom shoulder;

wherein the peripheral skirt forms vertical blades, at least some of which are separated by axial slots, the blocking hoop forming vertical branches that are arranged in the axial slots in the final mounted position; and wherein the blocking hoop comprises a top disk that is connected to a bottom blocking collar via at least two of the vertical branches.

2. The fastener device according to claim 1, wherein the fastener elements extend downwards below the vertical blades and are set back towards an inside, such that the blocking collar is received below the blades, in alignment therewith, in bearing contact with the fastener elements, in the final mounted position.

3. The fastener device according to claim 1, wherein the blocking collar is elastically deformable.

4. A fastener device for closing a fluid reservoir that is formed with a neck that is provided with outer peripheral reinforcement that co-operates with the remainder of the neck to define a bottom shoulder, said fastener device comprising:

a fastener ring for holding a closure member on the neck, the fastener ring including a peripheral skirt that extends around the neck to below the bottom shoulder, said skirt being provided with fastener elements that each form a contact zone configured to engage the neck below the bottom shoulder, depending on an axial position of the respective contact zone relative to the bottom shoulder, so as to fasten the ring on the neck; and a blocking hoop that is engaged around the peripheral skirt in a final mounted position, so as to block at least some of the fastener elements below the bottom shoulder;

wherein the peripheral skirt forms vertical blades, at least some of which are separated by axial slots, the blocking hoop forming vertical branches that are arranged in the axial slots in the final mounted position; and wherein the axial slots extend over an entire height of the skirt, such that the branches extend in the axial slots without creating extra thickness at the skirt.

5. The fastener device according to claim 1, wherein the blocking hoop forms a blocking collar that is held temporarily on the skirt of the fastener ring in a pre-mounted position, before being moved axially into its final mounted position.

6. The fastener device according to claim 1, wherein some vertical blades are interconnected at bottom ends of the vertical blades via spacers that support the fastener elements, a pair of vertical blades thus forming between them a window above the respective spacer.

7. The fastener device according to claim 1, wherein the contact zones are situated at different axial heights, such that some contact zones come into operating engagement below the bottom shoulder, while other contact zones remain inoperative.

8. The fastener device according to claim 7, wherein the fastener elements are radially movable, so as to pass over the outer reinforcement of the neck and come into engagement below the bottom shoulder.

9. The fastener device according to claim 1, wherein the fastener elements comprise tabs that extend freely downwards, the tabs forming inwardly- and upwardly-directed rims that define contact zones of different axial heights.

10. A fluid reservoir including a neck that is provided with the fastener device according to claim 1, for holding a closure member on the neck.

11. The fastener device according to claim 4, wherein the blocking hoop forms a blocking collar that is held temporarily on the skirt of the fastener ring in a pre-mounted position, before being moved axially into its final mounted position.

12. The fastener device according to claim 4, wherein some vertical blades are interconnected at bottom ends of the vertical blades via spacers that support the fastener elements, a pair of vertical blades thus forming between them a window above the respective spacer.

13. The fastener device according to claim 4, wherein the contact zones are situated at different axial heights, such that some contact zones come into operating engagement below the bottom shoulder, while other contact zones remain inoperative.

14. The fastener device according to claim 13, wherein the fastener elements are radially movable, so as to pass over the outer reinforcement of the neck and come into engagement below the bottom shoulder.

15. The fastener device according to claim 4, wherein the fastener elements comprise tabs that extend freely downwards, the tabs forming inwardly and upwardly directed rims that define contact zones of different axial heights.

16. A fluid reservoir including a neck that is provided with the fastener device according to claim 4, for holding a closure member on the neck.

* * * * *